US005280820A

United States Patent [19]

Voss et al.

[11] Patent Number: 5,280,820

[45] Date of Patent: * Jan. 25, 1994

[54] METHOD FOR METALLURGICALLY BONDING CYLINDER LINERS TO A CYLINDER BLOCK OF AN INTERNAL COMBUSTION ENGINE

[75] Inventors: Karl D. Voss, Farmington Hills; Thomas E. Prucha, Brighton, both of Mich.; John W. Kuhn, Bristol, Ind.

[73] Assignee: CMI International, Southfield, Mich.

[ * ] Notice: The portion of the term of this patent subsequent to Jan. 19, 2010 has been disclaimed.

[21] Appl. No.: 821,763

[22] Filed: Jan. 15, 1992

[51] Int. Cl.[5] ..... B22D 19/08

[52] U.S. Cl. ..... 164/100; 164/98; 164/75

[58] Field of Search ..... 164/100, 75, 98

[56] References Cited

U.S. PATENT DOCUMENTS

| | | | |
|---|---|---|---|
| 1,710,136 | 4/1929 | Angle et al. | 123/193 |
| 2,455,457 | 12/1948 | Whitfield et al. | 309/2 |
| 3,069,209 | 12/1962 | Bauer | 309/3 |
| 3,165,983 | 1/1965 | Thomas | 92/169 |
| 3,276,082 | 10/1966 | Thomas | 22/204 |
| 3,465,423 | 9/1969 | Kiesler et al. | 164/75 |
| 3,945,423 | 3/1976 | Hannig | 164/75 |
| 4,102,033 | 7/1978 | Emi et al. | 164/100 |
| 4,936,270 | 6/1990 | Ushio et al. | 123/193 C |
| 4,997,024 | 3/1991 | Cole et al. | 164/75 |
| 5,005,469 | 4/1991 | Ohta | 92/169.4 |

*Primary Examiner*—Paula A. Bradley
*Assistant Examiner*—Erik R. Puknys
*Attorney, Agent, or Firm*—Reising, Ethington, Barnard, Perry & Milton

[57] ABSTRACT

A method for metallurgically bonding cylinder liners (12, 12') within a cylinder block 14 of an internal combustion engine. The liners (12, 12') are cleaned (16) and their outer surfaces coated (18) with a low melting point cooling material (20) such as molten zinc forming a metallurgical bond therebetween. The coating (20) is allowed to solidify forming an outer oxidized layer (24) on the coating (20). The oxidized layer (24) is subsequently removed to expose an unoxidized outer surface (26) of the coating (20). The coated liners (12, 12') are then disposed within a casting mold and molten aluminum-based cylinder block material (36) is poured into the mold and about the coated liners (12, 12'). The molten cylinder block material (36) remelts the coating (20) on the liners (12, 12') and causes the coating to further alloy with the cylinder block material (36), whereupon cooling the cylinder liners (12, 12') are metallurgically bonded to the cylinder block (14).

24 Claims, 1 Drawing Sheet

METHOD FOR METALLURGICALLY BONDING CYLINDER LINERS TO A CYLINDER BLOCK OF AN INTERNAL COMBUSTION ENGINE

BACKGROUND OF THE INVENTION

1. Technical Field

The subject invention relates to a method for metallurgically bonding a cylinder liner with a cylinder block of an internal combustion engine.

2. Description of the Related Prior Art

It is becoming more and more common in today's automotive industry to form the cylinder block of internal combustion engines out of aluminum rather than cast iron. The aluminum is much lighter than the cast iron and contributes to a more fuel efficient automobile.

These aluminum engine blocks are typically provided with cylinder liners made of cast iron or other suitable material for providing a high wear resistent surface to the cylinder walls of the engine block. In order to prevent the liners from moving and rendering the engine inoperable, it is important that the cylinder liners be securely joined to the cylinder block.

One common method for joining the liner to the block is to create a mechanical interference between the liner and the block. One known method involves pressing the preformed liner into the engine block under an interference fit. Another method involves casting the cylinder block around the cylinder liners to form a mechanical interlock between the liners and the cylinder block. Although these types of liners have enjoyed some commercial success, they are deficient in that a mechanically joined liner tends to loosen over time. This is caused by the continuous thermal cycling of the engine and the different coefficients of expansion of the liner and cylinder block materials. The loosened liner tends to warp and lose its cylindrical shape as well as decrease the ability of the liner to transfer heat to the cylinder block. An example of such a liner is disclosed in U.S. Pat. No. 3,069,209 to Bauer, granted Dec. 18, 1962.

Another method for securing the liner to the cylinder block is to metallurgically bond the liner to the cylinder block. Such a method is disclosed in U.S. Pat. No. 1,710,136 to Angle et al, granted Apr. 23, 1929. Other examples include the U.S. Pat. Nos. 3,165,983, granted Jan. 19, 1965 and corresponding divisional U.S. Pat. No. 3,276,082, granted Oct. 4, 1966, both to Thomas, and U.S. Pat. No. 5,005,469, granted Apr. 9, 1991 to Ohta.

Although the method disclosed in the Thomas '983 and '082 patents reportedly form a metallurgical bond between the cylinder liner and the cylinder block, practice has shown that a satisfactory metallurgical bond is not formed. Although Thomas pays particular attention to the surface preparation of the liner prior to coating the liner with the bonding material, Thomas does not address the problems of bonding the molten cylinder block material with the resultant coating on the liner. In particular, the coating materials, such as zinc, develop an outer oxidized layer or skin after the liner has been coated. This is particularly true when the coating is applied by dipping the cylinder liners in a bath of molten zinc. As the coated liner is withdrawn from the molten bath of zinc and the coating is solidifying, the outer surface of the coating oxidizes. When the coated cylinder is subsequently disposed in the casting mold and molten cylinder block defining material is poured into the mold, the oxidized surface of the coating greatly inhibits the ability of the coating to alloy with the cylinder block material, thus preventing the formation of a satisfactory metallurgical bond upon cooling. Thomas does not address the problems associated with an oxidized coating as it relates to the success or failure of forming a satisfactory metallurgical bond.

SUMMARY OF THE INVENTION AND ADVANTAGES

According to the subject invention, a method is provided for metallurgically bonding a cylinder liner with a cylinder block of an internal combustion engine. The method includes the steps of forming a cylinder liner and thereafter coating the exterior surface of the cylinder liner with a molten low melting metal material and allowing the coating to solidify. An outer oxidized layer of the coating is removed for exposing an unoxidized outer coating surface. The coated liner is disposed within a casting cavity of a cylinder block casting mold and molten aluminum-based metal cylinder block material is cast into the casting cavity and around the cylinder liner, causing the coating to remelt an alloy with both the cylinder liner material and the cylinder block material, whereupon cooling the cylinder liner metallurgically bonds with the resultant cylinder block.

The method of the subject invention overcomes the disadvantages of the prior art by removing the oxidized layer of the coating prior to casting the cylinder block material about the liner. By removing the oxidized layer, an unoxidized surface of the coating is exposed. This unoxidized surface readily alloys with the molten casting block material to form a uniform, high integrity metallurgical bond between the liner and the cylinder block upon cooling. Such a bond is stronger than a mechanical bond and exhibits superior heat transfer properties between the liners and the cylinder block.

Additional advantages of forming a high quality metallurgical bond between the liners and the cylinder block is that the liners are able to resist warpage and thus retain their cylindricity, unlike mechanically bonded liners.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE DRAWINGS

Figure 1:
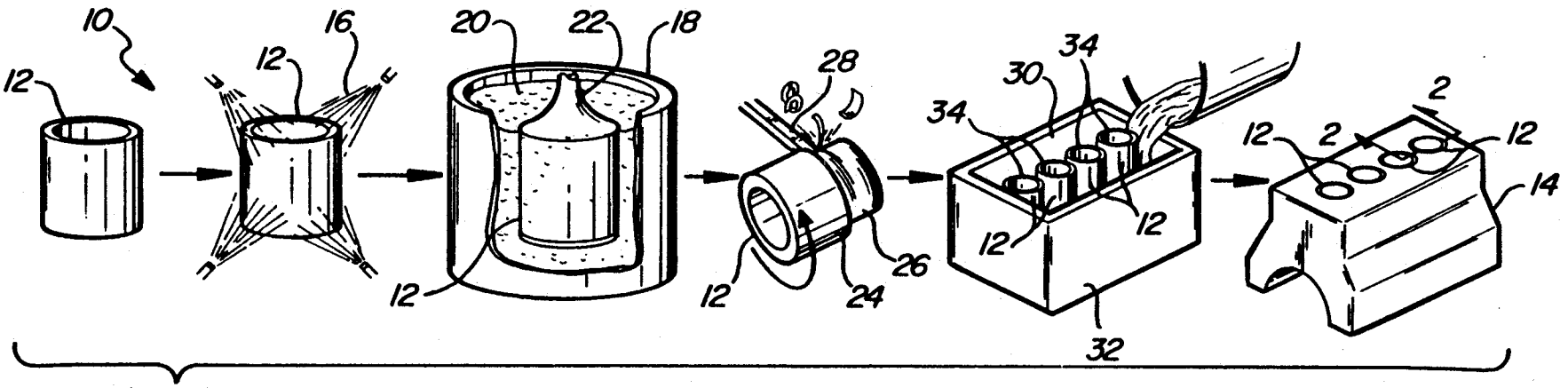
FIG. 1 is a schematic illustration of the various steps of the subject invention.

The subject invention provides a method for metallurgically bonding one article to another. This method, generally indicated at 10 in FIG. 1, has shown to be particularly useful in bonding cylinder liners 12 with a cylinder block 14 of an internal combustion engine (not shown) and will be described below with reference to such application.

The first step in this process includes forming a required number of cylinder liners 12 to be bonded with the cylinder block 14. The required number of cylinder liners 12 will depend upon the number of piston cylinders to be formed within the cylinder block 14. A straight four cylinder block 14 is shown for illustrative purposes.

The cylinder liners 12 are formed with generally cylindrical inner and outer wall surfaces having a circular or a ring-shaped cross section and a predetermined wall thickness. The cylinder liners 12 are formed of a high wear resistant material, such as cast iron, steel, or high silicon aluminum based alloys.

After the cylinder liners 12 have been formed, their outer surfaces may be cleaned 16 to remove any grease or other foreign matter to prepare the outer surfaces for coating.

Following cleaning, the outer surface of each liner 12 is coated 18 with a molten low melting metal material 20. One way of coating the liners 12 includes fixturing the liners 12 in an appropriate fixture 22 and lowering them into a bath of the coating material 20, such as zinc-based material, which has been heated to a molten state. Other coating materials may also be suitable provided they have a relatively low melting point and will alloy with the liner material and the aluminum-based cylinder block material. Thus, materials such as tin-based materials and cadmium-based materials would also be suitable.

The cylinder liners 12 are kept within the molten zinc bath for a sufficient time to allow the coating material 20 to metallurgically bond with the liners 12. In other words, coating 20 is not just coated onto the surface of each cylinder liner 12, but is chemically adhered thereto by diffusing and alloying with the liners 12. Metallurgical bonding thus means to form a new alloy different from either the coating material or the liner material as a result of the chemical combination of the two materials.

After the cylinder liners 12 have been left in the molten bath for a sufficient amount of time, they are pulled out of the bath and allowed to cool in an oxidizing atmosphere until the coating 20 on each liner 12 solidifies. That is, the liner 12 and cooling material 20 are cooled to a temperature below that of the melting point of the coating material 20. As each coated liner 12 is being pulled out of the bath and cooling, the outermost surface of the coating 20 oxidizes upon exposure to the atmosphere, thereby forming an outer oxidized layer 24 on the coating 20. In the case of a zinc coating, an outer zinc oxide layer 24 is formed on each coating 20.

The outer oxidized layer 24 is subsequently removed 28, such as by machining, from the coated cylinder liner 12 for exposing an unoxidized outer surface 26 of the coating 20. In the case of zinc coating 20, this unoxidized surface 24 would be essentially pure zinc. Because the liners 12 are now at a lower temperature than they were coming out of the molten bath, the rate of oxidation of this new unoxidized surface 26 is substantially less, giving the coated liner 12 a shelf life of several days or possibly weeks before reoxidizing sufficiently to inhibit metallurgical bonding.

The next step is to preheat the deoxidized coated liners 12 and dispose them within a casting cavity 30 of a cylinder block-defining casting mold 32. The liners 12 may be supported by cores or mandrels 34 within the mold 32. Once the liners 12 are positioned, molten aluminum-based metal cylinder block material 36 is cast into the casting cavity 30 and around the coated cylinder liners 12. The aluminum-based cylinder liner material 36 has a higher melting point than the coating material 20 and thus causes the coating on the liners 12 to remelt and alloy with the aluminum-based cylinder block material 36, where upon cooling the liners 12 metallurgically bond to the resultant cylinder block 14.

Figure 2:
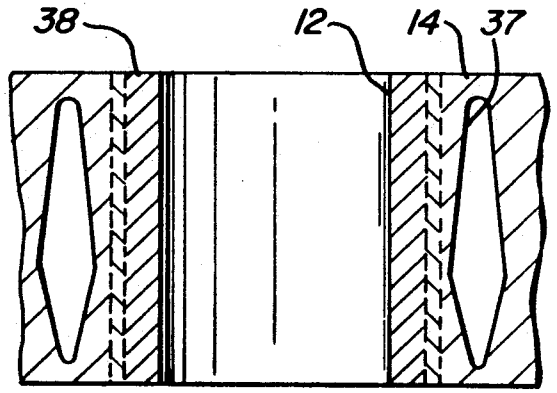
FIG. 2 is a cross-sectional view taken along lines 2—2 of FIG. 1.

A cross-sectional view of one of the piston cylinders of the cylinder block 14 is shown in FIG. 2. As can be seen, the cylinder liner 12 forms the wall or wear surface of the piston cylinder and is surrounded by the cylinder block 14. A water jacket chamber 37 extends around the cylinder liner 12 as well. An intermediate metallurgically bonded region lies between the cylinder liner 12 and the cylinder block 14 and is made up of the coating material 20 alloyed or combined with both the cylinder liner material 12 and cylinder block material 36. The dotted lines are used to define the metallurgically bonded region and to indicate that there is no distinctive interface between the metallurgically bonded region, the liner 12 and cylinder block 14, but rather a smooth, interface-free transition. In other words, there is a chemical transition from pure cylinder block material 36 of the block 14, to an alloyed composition of the coating material 20 combined with the cylinder block material 36 and liner material (bonded region) and then to pure liner material of the liner 12.

An upper sealing surface 38 of the cylinder liner 12 is free from the cylinder block material 36 (i.e., exposed) and is wide enough for receiving and sealingly engaging a head gasket (not shown) of an engine (not shown). The liners 12 of FIG. 1 are thus formed having a uniform thickness corresponding to the width requirements of the upper surface 38.

Figure 3:
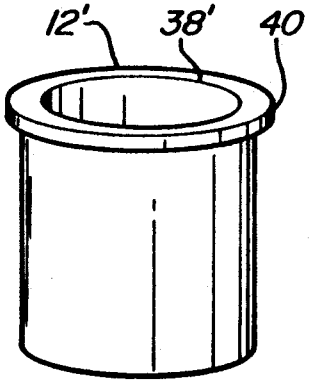
FIG. 3 is a perspective view showing an alternative configuration of the cylinder liner.
Figure 4:
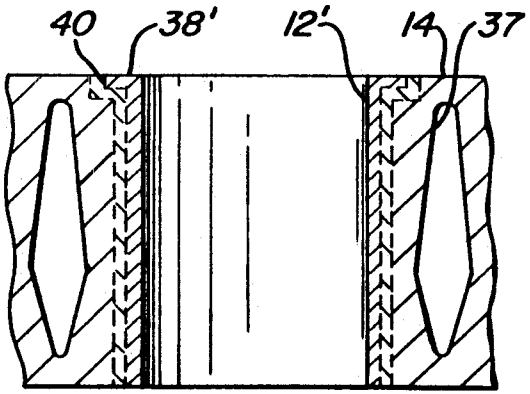
FIG. 4 is a cross-sectional view like FIG. 2 but with the cylinder liner of FIG. 3 bonded to the cylinder block.

A second embodiment of a cylinder liner is shown at 12' in FIG. 3. This cylinder liner 12' is similar to the ones illustrated in FIGS. 1 and 2 except that it has a thinner wall thickness and is formed with a radially outwardly extending flange 40 on one end of the cylinder liner 12'. As seen in FIG. 4, the thickness of this alternative cylinder liner 12' is substantially less than that of the previously described cylinder liner 12. However, the necessary upper surface width can still be achieved with this thin-walled liner 12' by the flange 40.

Once this liner 12' has been formed, it is processed in the same manner as described previously for the liner 12 of FIGS. 1 and 2. As can be seen in FIG. 4, the upper sealing surface 38' of the flange 40 is free from the cylinder block material 14 for sealingly receiving a head gasket (not shown) thereon, in the same manner as the cylinder liner 12 of the first embodiment.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. A method for metallurgically bonding a cylinder liner with a cylinder block of an internal combustion engine, said method comprising the steps of:

forming a cylinder liner (12);

coating (18) the exterior surface of the cylinder liner (12) with a molten low melting point metal coating material (20) selected from a group consisting of zinc, tin, cadmium, and their alloys and allowing the coating (20) to solidify forming an outer oxidized surface (24) on the coating (20);

removing the outer oxidized surface (24) from the solidified coating (20) and exposing an unoxidized outer coating surface (26);

disposing the coated liner (12) within a casting cavity (30) of a cylinder block casting mold (32); and casting molten aluminum-based metal cylinder block material (36) into the casting cavity (30) and around the coated cylinder liner (12) causing the coating (20) to remelt and alloy with both the cylinder liner material and the cylinder block material (36) whereupon cooling the cylinder liner (12) metallurgically bonds with the resultant cylinder block (14).

2. A method as set forth in claim 1 further characterized by cleaning (16) the outer surface of the liner (12) prior to coating (18) the liner (12) with the coating material (20).

3. A method as set forth in claim 1 further characterized by removing the outer oxidized surface (24) prior to disposing the coated cylinder liner 12) within the casting cavity (30) of the mold (32).

4. A method as set forth in claim 1 further characterized by mechanically removing the outer oxidized surface (24) of the coating (20).

5. A method as set forth in claim 4 further characterized by machining the coated liner (12) to remove the outer oxidized surface (24) of the coating (20).

6. A method as set forth in claim 1 further characterized by forming the cylinder liner (12) from cast iron material.

7. A method as set forth in claim 1 further characterized by forming the cylinder liner (12) from high silicon content aluminum-based material.

8. A method as set forth in claim 1 further characterized by forming the cylinder liner (12) from steel.

9. A method as set forth in claim 1 further characterized by coating (18) the cylinder liner (12) with a zinc-based metal coating material (20).

10. A method as set forth in claim 1 further characterized by coating (18) the cylinder liner (12) with a tin-based metal coating material (20).

11. A method as set forth in claim 1 further characterized by coating (18) the cylinder liner (12) with a cadmium-based metal coating material (20).

12. A method as set forth in claim 1 further characterized by forming a radially outwardly extending flange (40) on one end of the cylinder liner (12) with an upper sealing surface (38') thereof which is free of the cylinder block material (36) for receiving a head gasket thereon.

13. A method for metallurgically bonding a cylinder liner with a cylinder block of an internal combustion engine, said method comprising the steps of:

forming a cast iron cylinder liner (12);

coating (18) the outer surface of the cylinder liner (12) with molten zinc-based metal coating material (20) causing the coating material (20) to alloy with the cylinder liner material and thereafter cooling the coating (20) and liner (12) to a temperature below that of the melting point of the coating material (20) forming a metallurgical bond between the liner (12) and the coating (20) and further forming an outer oxidized surface (24) of the coating (20);

removing the outer oxidized surface (24) of the coating (20) and exposing an unoxidized outer surface (26) of the coating (20);

disposing the coated liner (12) within a casting cavity (30) of a cylinder block casting mold (32);

casting molten aluminum-based cylinder block material (36) into the casting cavity (30) and around the coated cylinder liner (12) causing the zinc-based coating (20) to remelt and further alloy with the aluminum-based cylinder block material (36) and thereafter cooling the coating (20), liner (12) and cylinder block material (36) to a temperature below that of the melting point of the coating (20) causing both the liner (12) and the resultant cylinder block (14) to metallurgically bond with the coating (20) and thus one another.

14. A method as set forth in claim 13 further characterized by removing the oxidized surface (24) before disposing the coated cylinder liner (12) within the casting cavity (30) of the mold (32).

15. A method as set forth in claim 14 further characterized by mechanically removing the oxidized surface (24) of the coated liner (12).

16. A method as set forth in claim 13 further characterized by cleaning (16) the outer surface of the liner (12) before coating (18) the liner (12).

17. A method as set forth in either of claims 13 or 16 further characterized by forming a radially outwardly extending flange (40) on one end of the liner (12) with an upper sealing surface (38') thereof which is free of the cylinder block material (36) for a head gasket of an internal combustion engine.

18. A method as set forth in claim 15 further characterized by machining the coated liner to remove the oxidized surface.

19. A method for metallurgically joining a first article to a second metal article, said method comprising the steps of:

coating (18) surfaces of the first article which are to be joined to the second metal article with a zinc-based metal coating material (20) and forming an oxidized surface (24) of the coating (20)

removing the oxidized surface (24) of the coating (20) and exposing an unoxidized surface (26) of the coating;

disposing the coated first article within a casting cavity (30) of a second article casting mold (32); and casting molten second article aluminum-based metal material (36) into the casting cavity (30) and against the coated first article causing the coating (20) to melt and alloy with the second article metal material (36) whereupon cooling the coating (20) metallurgically bonds with the resultant second article.

20. A method as set forth in claim 19 further characterized by removing the oxidized surface (24) before disposing the coated first article within the casting cavity (30) of the mold (32).

21. A method as set forth in claim 20 further characterized by mechanically removing the oxidized surface (24) from the coated first article.

22. A method as set forth in claim 21 further characterized by machining the coated first article to remove the oxidized surface.

23. A method as set forth in either of claims 19 or 22 further characterized by forming the first article from a metal material.

24. A method as set forth in claim 23 further characterized by heating the coating (20) and the first article metal material to a temperature above the melting point of the coating (20) causing the coating (20) to melt and alloy with the first article metal material forming a resultant metallurgical bond therebetween upon cooling.

* * * * *